US005566136A

United States Patent [19]

Schwartz et al.

[11] Patent Number: 5,566,136

[45] Date of Patent: Oct. 15, 1996

[54] MULTIFUNCTIONAL HOLDING PLATE FOR AN ANALOG WRISTWATCH WITH DATE RING

[75] Inventors: Herbert Schwartz, Wurmberg; Friedrich Mose, Pforzheim-Würm; Adolf Sedlak, Wurmberg-Neubärental; Hans-Georg Schnell, Karlsbad-Langensteinbach, all of Germany

[73] Assignee: Timex Corporation, Middlebury, Conn.

[21] Appl. No.: 619,288

[22] Filed: Mar. 18, 1996

[51] Int. Cl.[6] ..... G04B 19/24

[52] U.S. Cl. ..... 368/35; 368/37

[58] Field of Search ..... 368/34–38, 185, 368/187, 190

[56] References Cited

U.S. PATENT DOCUMENTS

| | | | |
|---|---|---|---|
| 3,750,385 | 8/1973 | Kocher | 368/35 |
| 3,775,965 | 12/1973 | Bessos et al. | 368/35 |
| 3,859,783 | 1/1975 | Wuthrich | 368/35 |
| 4,081,950 | 4/1978 | Chappatte | 368/37 |
| 5,083,300 | 1/1992 | Schwartz | 368/185 |
| 5,210,722 | 5/1993 | Schwartz | 368/88 |
| 5,446,703 | 8/1995 | Schwartz | 368/80 |

*Primary Examiner*—Vit W. Miska
*Attorney, Agent, or Firm*—William C. Crutcher

[57] ABSTRACT

A multifunctional holding plate for use in an analog wristwatch movement with a calendar date ring, a day of the week disc, an engageable time setting pinion and various gear members. The multifunctional holding plate is attached to the movement frame and has (1) retaining fingers to hold the gear members and date ring in place, (2) a flexible detenting spring leg to detent the date ring, (3) a flexible retaining leg to facilitate engagement of the timesetting pinion, and (4) a flexible detenting spring leg to detent the day disc.

7 Claims, 8 Drawing Sheets

MULTIFUNCTIONAL HOLDING PLATE FOR AN ANALOG WRISTWATCH WITH DATE RING

BACKGROUND OF THE INVENTION

This invention relates generally to analog wristwatch movements with additional features such as calendar mechanisms and which are adapted for ease of assembly. More particularly, the invention concerns an improved analog wristwatch movement with a special holding plate to organize the unattached gear train members into an easily transportable movement, to retain additional elements needed in a day/date calendar watch, to provide the detenting functions needed for a day disc and date ring in a calendar watch, and to provide spring loading functions to prevent damage to the setting mechanism.

Some types of analog wristwatch movements are designed to be assembled in situ into a watch case, adding unattached elements such as hour wheel, center wheel and minute wheel at the time of assembly before adding the watch dial. More complex watch assemblies with day/date calendar functions require the addition of more unattached components at the time of in situ assembly. This complicates the assembly process when the movement has to be transported between various work stations for operations in the factory, or when it must be packaged and shipped to another location for additional assembly work. It would be desirable to have the unattached components used in a day/date calendar watch, such as detent springs, date ring, day disc, all held in place so that the movement could be assembled into a watch case without undue difficulty.

The date ring and day disc used in day/date calendar mechanisms require spring loaded detenting members. Detent springs are sometimes supplied as separate members. It would be desirable to incorporate the detent springs and detent members into another member to reduce the number of parts.

Other functions are performed by special spring elements in an analog wristwatch movement to prevent damage. One example is the setting mechanism, in which a stem with a setting pinion is slidable within the movement to engage crown teeth on a setting wheel, which is permanently meshed with the timepiece gear train. In order to prevent damage, constructions are known in which the setting wheel is restrained by a spring member and allowed to move during engagement of the gear teeth in order to prevent damage.

An example of a day/date calendar watch utilized in a mechanical movement previously manufactured by applicant's assignee is shown in U.S. Pat. No. 3,859,783 issued to P. Wuthrich on Jan. 14, 1975. That patent shows a day/date wheel driven by the normal timekeeping gear train in a mechanical wristwatch to rotate once per day and to advance both a date ring and a day disc, each provided with its own separate detent spring.

U.S. No. Pat. 5,083,300 issued to H. Schwartz on Jan. 21, 1992 and assigned to applicant's assignee shows a timepiece setting mechanism including a yieldable support member to allow the minute wheel to move and prevent damage when its crown teeth are engaged by the setting pinion of the setting mechanism.

It would be desirable to provide a single multifunctional member which could accomplish all of the foregoing functions.

Accordingly, one object of the present invention is to provide a multifunctional holding plate, which will organize and hold in place a number of otherwise unattached gear train members and day/date calendar watch members in a wristwatch movement.

Another object of the invention is to provide a multifunctional holding plate which incorporates the spring loaded detent functions in a day/date calendar watch.

Another object of the present invention is to provide a multifunctional holding plate which incorporates a yieldable spring member to prevent damage to the setting mechanism.

DRAWINGS

The invention, both as to organization and method of practice, together with further objects and advantages thereof, will best be understood by reference to the following description, taken in connection with the accompanying drawings, in which:

FIG. 1 is a perspective view of a day/date analog wristwatch movement without the watch case or dial, FIG. 2 is the same perspective view with the day disc removed in order to show the elements of the partially assembled movement prior to attachment of the multifunctional holding plate which is the object of the present invention, FIG. 3 is the same perspective view after attachment of the multifunctional holding plate, FIG. 4 is a perspective view of the multifunctional holding plate itself, FIG. 5 is an elevation view, in cross section, through one half of the watch movement, showing the third wheel assembly and other elements of the gear train, FIG. 6 is a developed elevational view, in cross section, through one half of the watch movement, showing the intermediate wheel, stepping motor rotor and other elements of the gear train, FIG. 7 is a developed elevational view, in cross section, through one half of the watch movement illustrating the date ring and day disc drive mechanism, FIG. 8 is a developed elevational view in cross section through one half of the watch movement showing the minute wheel drive mechanism, and other elements of the gear train, FIG. 9 is a developed elevational view in cross section taken through one half of the watch movement, illustrating the setting mechanism, FIG. 10 is a developed elevational view in cross section taken through one half of the watch movement illustrating the stepping motor stator and other elements of the gear train, and FIG. 11 is a perspective view from the movement side of the watch with the movement removed looking toward the underside of the date ring and day disc.

SUMMARY OF TIE INVENTION

Briefly stated, the invention comprises an improvement in an analog wristwatch movement of the type having a frame, a timekeeping gear train disposed in the frame including an hour wheel and a center wheel coaxially disposed on an axis, a date mechanism driven by the gear train including a date ring with detenting teeth coaxially disposed on the axis, and a time setting mechanism including a setting wheel connected to the center wheel, the time setting mechanism including a radially slidable setting pinion which is selectively engageable with the setting wheel. The improvement comprises a multifunctional holding plate defining a central aperture and adapted to be connected to the frame with the aperture substantially centered on the axis, the plate having outer peripheral portions overlapping the date ring detenting teeth to hold the date ring in place, the plate further defining a plurality of retaining fingers extending radially into said aperture so as to overlap the outer periphery of the hour wheel and to retain the hour wheel and center wheel in place, and at least one radially flexible first detenting spring leg formed by an outer part of said plate and terminating in a detenting member engaging the detenting teeth of the date ring. In its preferred form the plate may also provide at least one axially flexible retaining leg defined by a plate portion and engaging the setting wheel to retain it in place while allowing limited movement to permit selective engagement by the setting pinion without damage. In a day/date watch, a day disc may also be added, and a radially flexible second detenting spring leg may be provided by the plate for detenting the day disc.

DESCRIPTION OF THE PREFERRED EMBODIMENT

Figure 1:
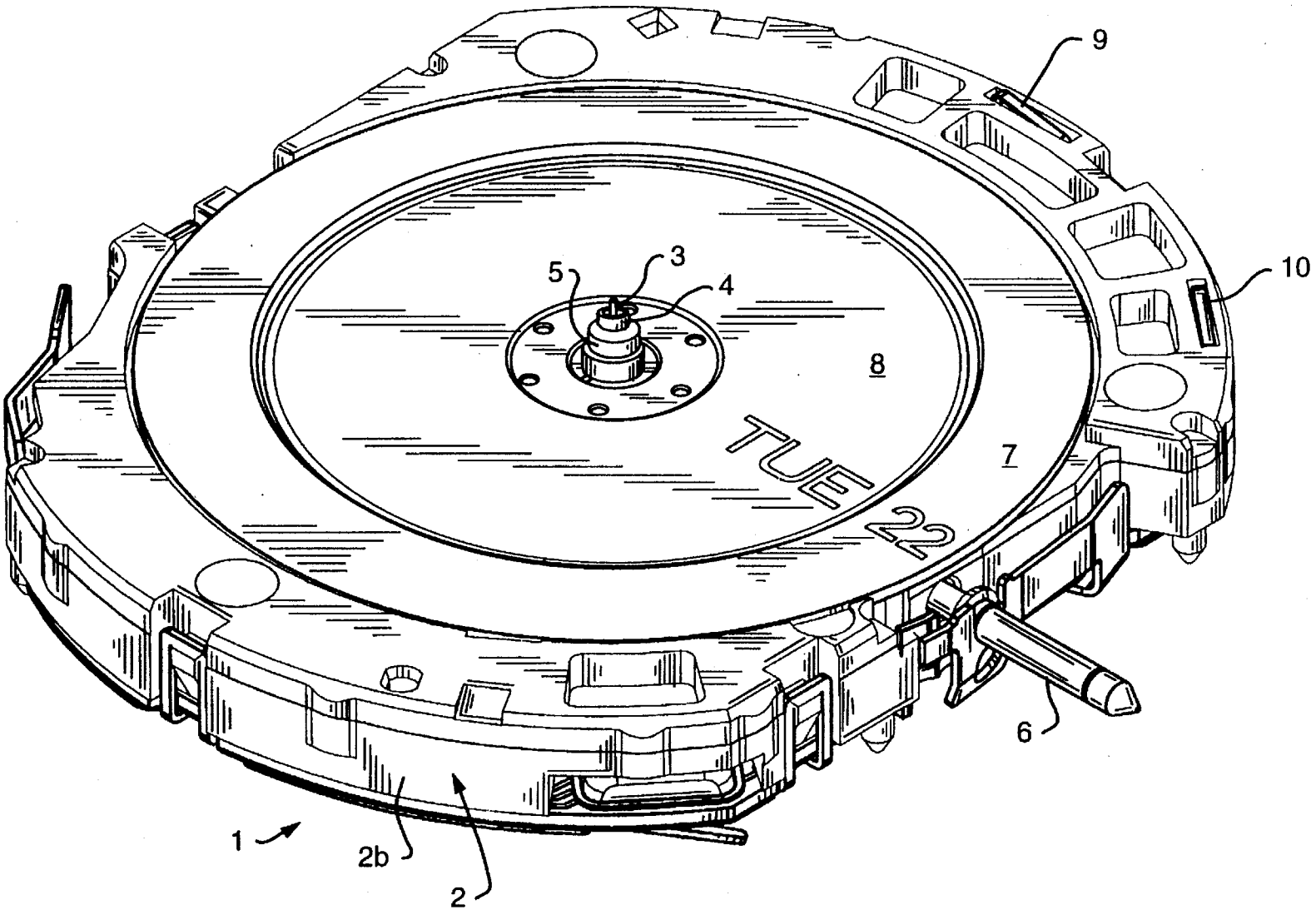

Referring now to FIG. 1 of the drawing, an analog wristwatch movement, shown generally at 1 in perspective view, comprises a frame 2 containing conventional timekeeping mechanism and energy cell connected with a gear train to rotate a seconds spindle 3, a tubular minutes hand axle 4 extending from the center wheel (not shown), and a tubular hours hand axle 5 attached to the hours hand (not shown). Spindle 3 and axles 4, 5 are coaxial about an axis about which the watch hands rotate. A radially slidable, rotatable crown and stem assembly 6 is provided for setting the wristwatch hands. The terms radially and axially used herein, refer to the aforementioned axis of the watch hands. A date ring 7 and a day disc 8 are provided with markings for 31 days of the month and for seven days of the week respectively, only one calendar date and one day of the week being shown in the drawing. Some watches omit the day disc 8 and only have a date ring.

Movement 1 is provided with spring contact members 9, 10 which are connected internally in the movement so as to actuate an electroluminescent dial (not shown). The dial is added after the movement 1 is assembled into a case (not shown) and following this, seconds, minute and hour hands are added to the respective axles 3, 4, 5. The dial will include a window cutout exposing the calendar date (and the day of the week in the movement is a"day/date" movement). The internal timekeeping mechanism, energy cell, stepping motor, and timekeeping circuit are conventional. Examples may be seen by reference to U.S. Pat. No. 5,210,722 issued May 11, 1993 or U.S. Pat. No. 5,446,703 issued Aug. 29, 1995, each to Herbert Schwartz and assigned to applicant's assignee.

Figure 2:
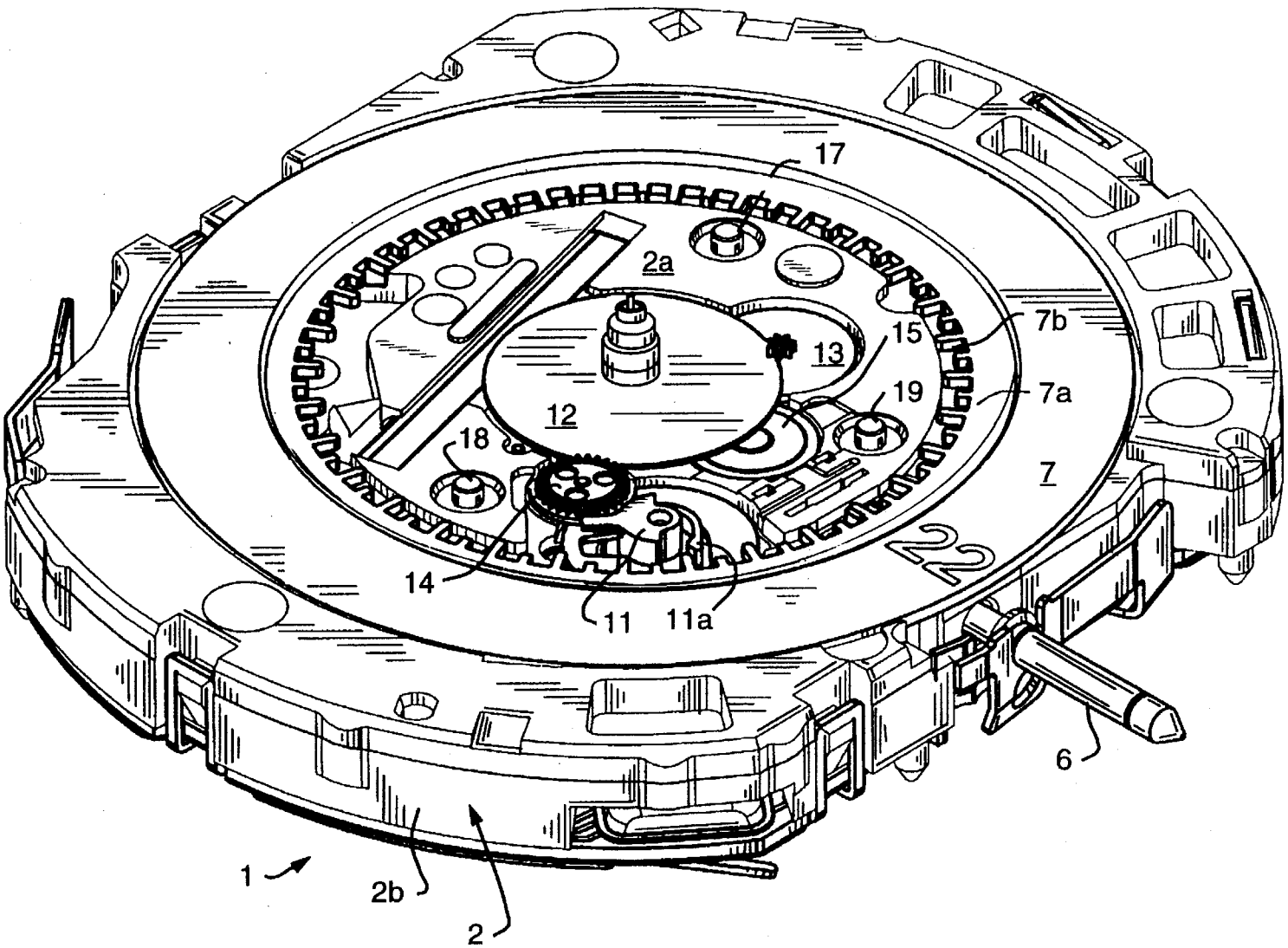

Referring now to FIG. 2 of the drawing, the movement 1 is shown in a partial assembly state without the day disc 8 and without the multifunctional holding plate which is the subject of the present invention. The date ring 7 is seen to include a radially inner circular flange 7*a* terminating in radially extending, alternating short and long teeth 7*b*. These are employed to advance the date ring by means of a special date wheel 11 having a pawl 11*a*. Date wheel 11 also serves to advance the day disc by engagement with teeth on its underside in a manner to be explained.

Frame 2 includes a central wall 2*a* separating the dial side gear members from the movement side gear members. Wall 2*a* includes various cutout sections in order to receive members of the dial side gear train. Some of these members shown in FIG. 2 are an hour wheel assembly 12, a minute wheel 13, a date pinion 14, and a setting wheel 15. Normally, the separate components including date ring 7, date wheel 11, center wheel assembly (not shown), hour wheel assembly 12, minute wheel 13, date pinion 14, and setting wheel 15, are assembled in situ while putting the movement into the case.

In accordance with the present invention, a multifunctional holding plate 16 is attached to the central wall 2*a* of frame 2 by means of three plastic stubs 17, 18, 19, projecting from central wall 2*a*, these being upset by ultrasonic welding.

Figure 3:
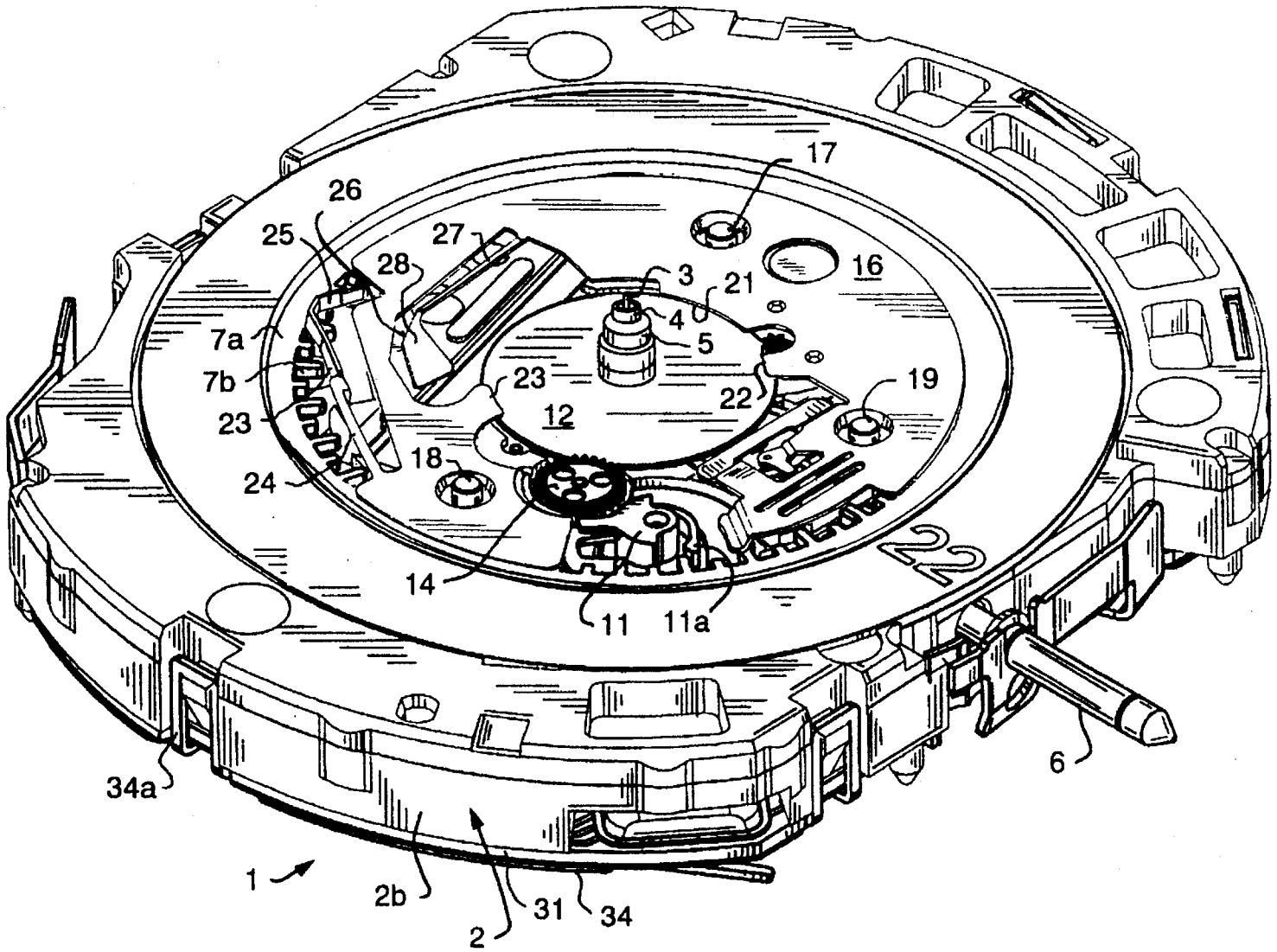
Figure 4:
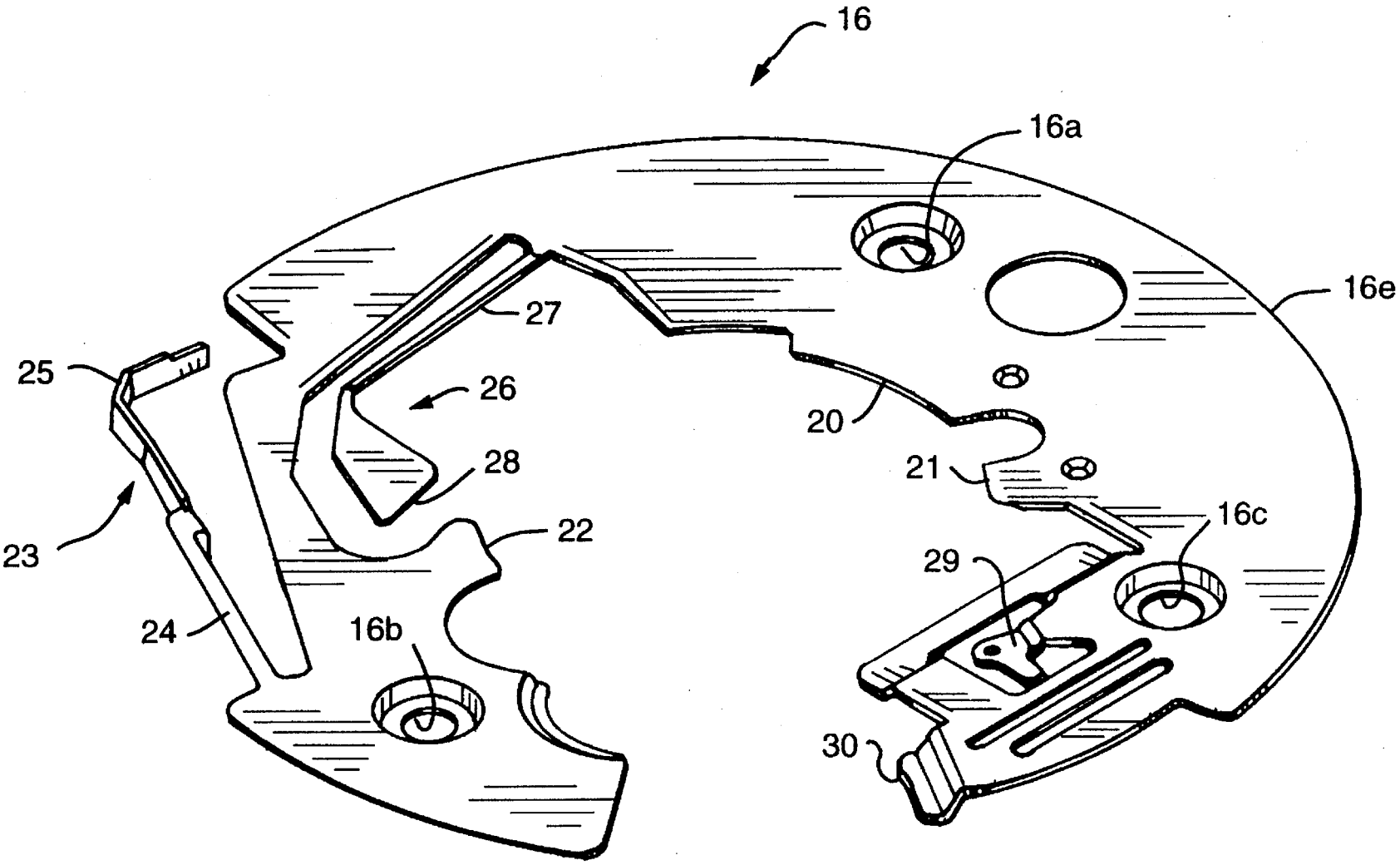

Reference to FIG. 4 illustrates the multifunctional holding plate to be a generally C-shaped plate member, having three holes 16*a*, 16*b*, 16*c* receiving the plastic stubs 17, 18, 19 respectively. The plate is formed about a central aperture 16*d* Retaining fingers 20, 21, 22, which are relatively inflexible, extend radially inward into the aperture and are so dimensioned as to overlap the periphery of the hour wheel assembly 12 as shown more clearly in FIG. 3. The outer periphery 16*e* of the plate member is dimensioned with respect to the axis so as to overlap the detent teeth 7*b* of date ring 7.

Plate 16 incorporates two spring detent members. A spring loaded date ring detent 23 is formed by cutting out and twisting a first detenting spring leg 24 from an outer part of the holding plate 16. The spring leg 24 terminates in a V-shaped detent member 25. Leg 24 is made of considerable length so that the date ring detent member 23 is radially flexible. A similar day disc detent member 26 is formed from another part of the plate 16 by a second detenting spring leg 27 terminating in a detent member 28. Leg 27 is of such length as to provide that member 26 is also radially flexible.

Lastly, FIG. 4 shows a special retaining leg 29 for the setting wheel. Leg 29 is axially flexible, i.e., flexible in a direction parallel to the watch hand axis, in order to permit movement of the setting wheel in an axial direction on its mounting stub, as will be explained. Lastly, plate portion 30 is offset in an axial direction in order to engage and hold in place the date wheel 11.

A better understanding of the arrangement of timekeeping elements within the frame 2 will be understood by reference to the cross sectional drawings of FIGS. 5–9.

Figure 5:
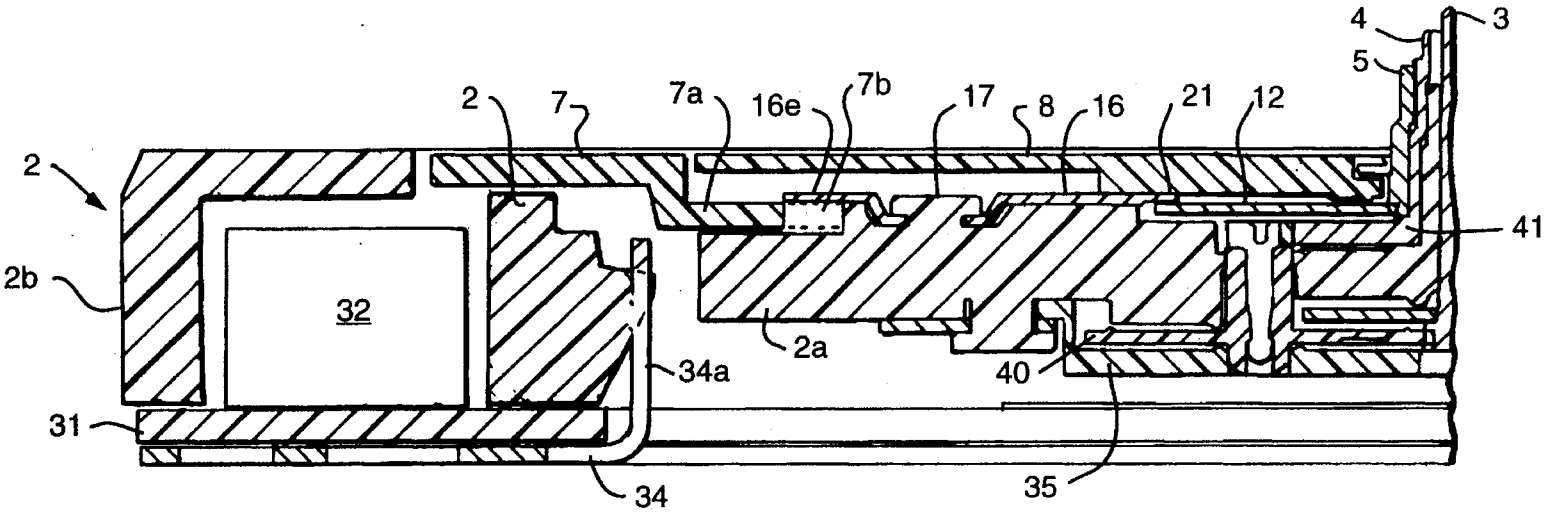
Figure 6:
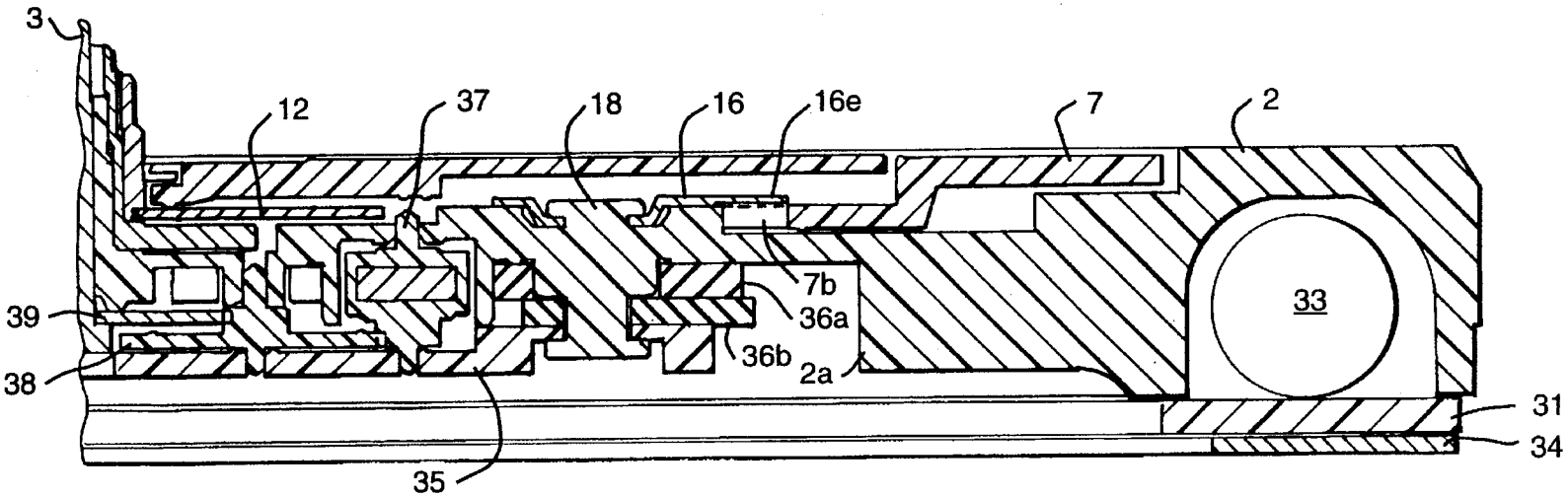
Figure 10:
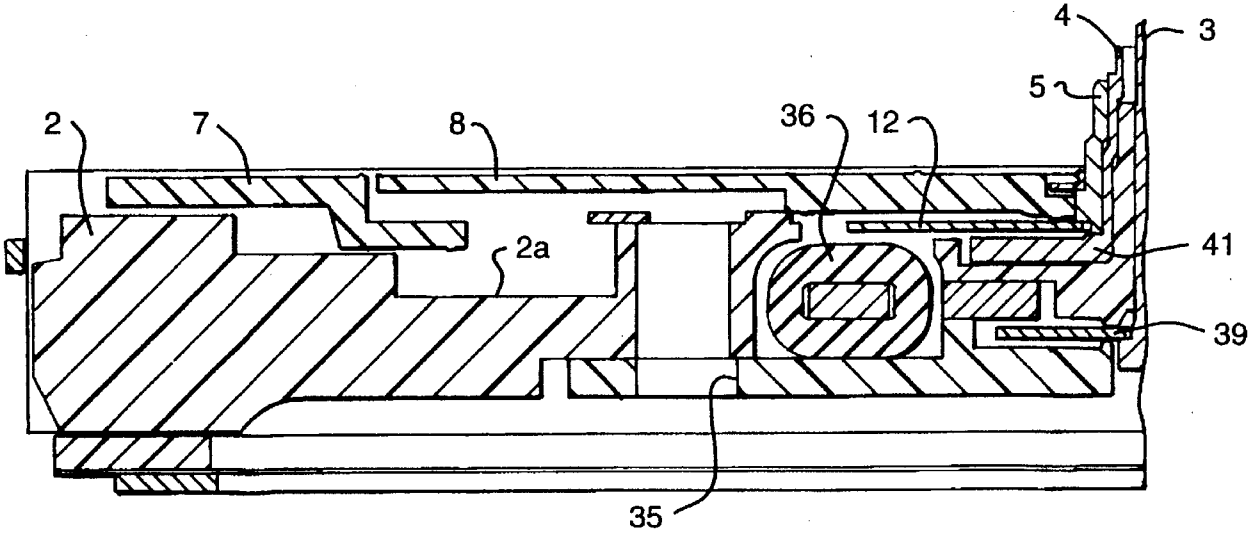

Referring to FIG. 5, frame 2 includes an annular wall 2*b* surrounding the movement enclosure, and also includes the central wall 2*a* dividing the dial side elements on top from the movement side elements on the bottom. An annular printed circuit board 31 carries the necessary circuit elements, including discrete electronic components such as inductor 32 and quartz crystal 33 (FIG. 6). The printed circuit board is held in place by an annular conductive spring plate 34 with spring clip arms 34*a* for attachment to the frame. The construction of the annular printed circuit board and annular conductive spring plate are substantially as described in the aforementioned U.S. Pat. No. 5,446,703 issued Aug. 29, 1995 to Schwartz and assigned to the present assignee. A bridge 35 cooperates with the central wall 2*a* to provide a mounting and bearings for the rotating elements. The gear train is powered by stepping motor comprising a stator assembly 36 (FIG. 10) including a stator core 36*a* with bridge 36*b*, and a permanent magnet rotor 37 (FIG. 6). The stepping motor rotor 37 has a gear pinion which meshes with the wheel of an intermediate wheel assembly 38. The latter includes a pinion which meshes with a seconds wheel 39 connected to the seconds spindle 3 (FIG. 10). Seconds spindle 3 includes a pinion meshing with the wheel of a third wheel assembly 40 (FIG. 5). Third wheel assembly 40 includes a slip clutch constructed in the manner disclosed in U.S. Pat. No. 5,155,712 issued Oct. 13, 1992 to Mose et al. and assigned to the present assignee. A pinion of the third wheel assembly 40 meshes with a center wheel 41, which also carries the minute hand on axle 4.

Figure 8:
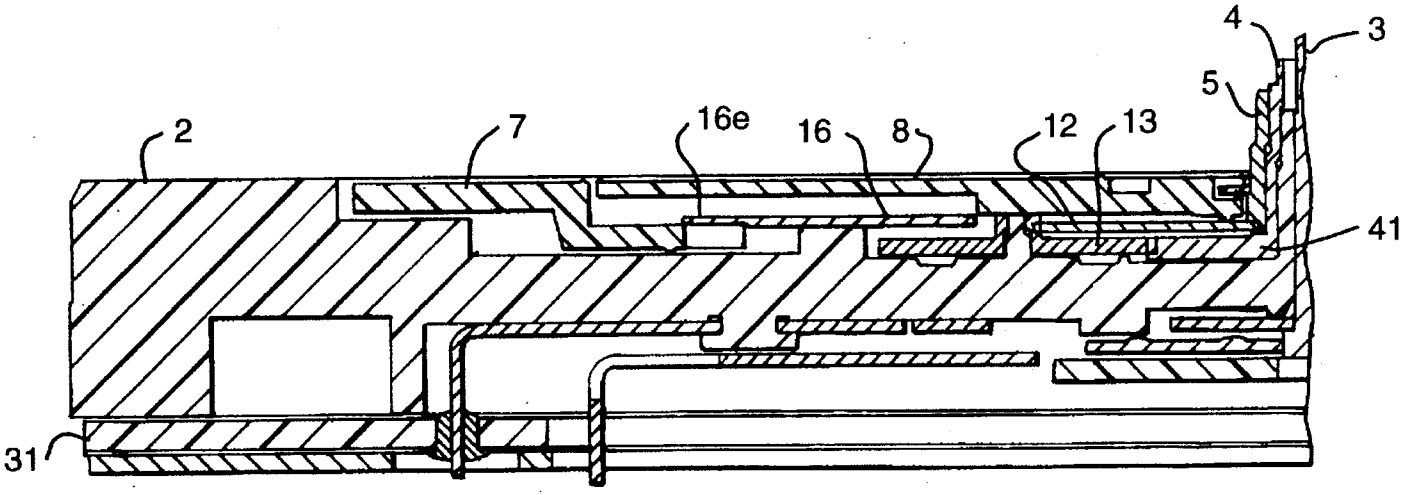

As seen in FIG. 8, center wheel 41 also meshes with the minute wheel 13. Minute wheel 13 includes a pinion meshing with hour wheel 12, which is connected to the axle 5 carrying the hour hand. This completes the description of the necessary elements to provide a three hand analog movement.

Figure 7:
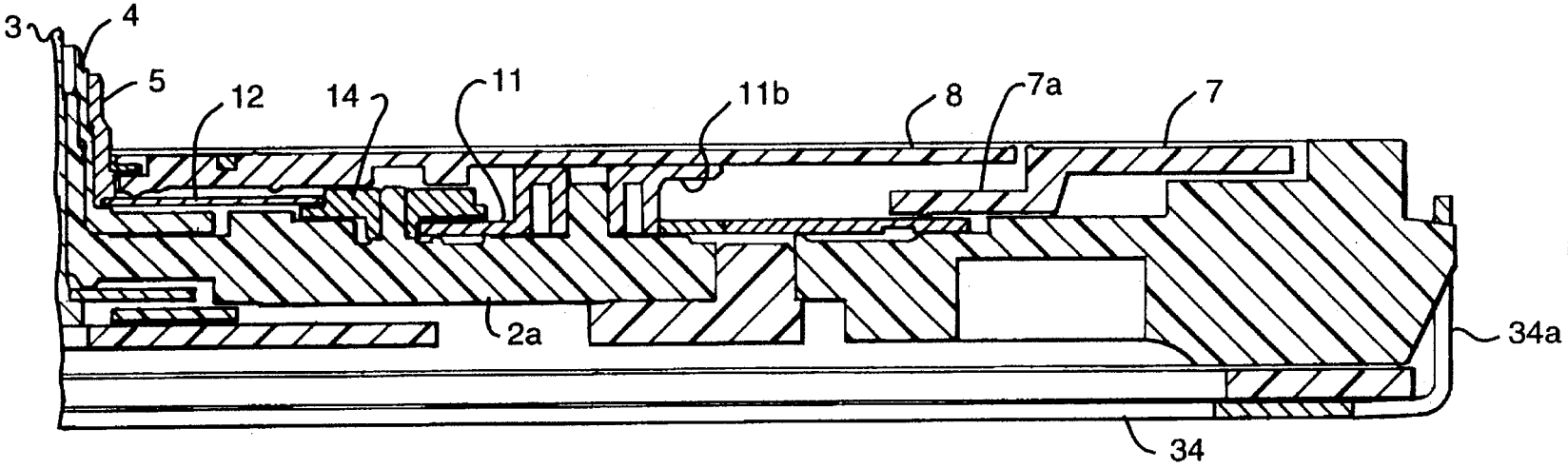

Turning now to the additional elements necessary to provide a day/date calendar mechanism, reference to FIG. 7 shows the hour wheel 12 also meshes with the date pinion 14, which in turn meshes with the date wheel 11. Date wheel 11 includes a pawl 11*a* (shown in FIGS. 2 and 3), which cooperates with date ring teeth 7*b* to advance the date once every twenty-four hours. Date wheel 11 also includes a single tooth 11*b* which engages radial teeth on the underside of day disc 8. Finally, day disc 8 is held in place by a holding ring 42 which is held with a friction fit on the hour hand stub 5. In the case of a calendar date watch without the day of the week, day disc 8 is omitted.

Figure 9:
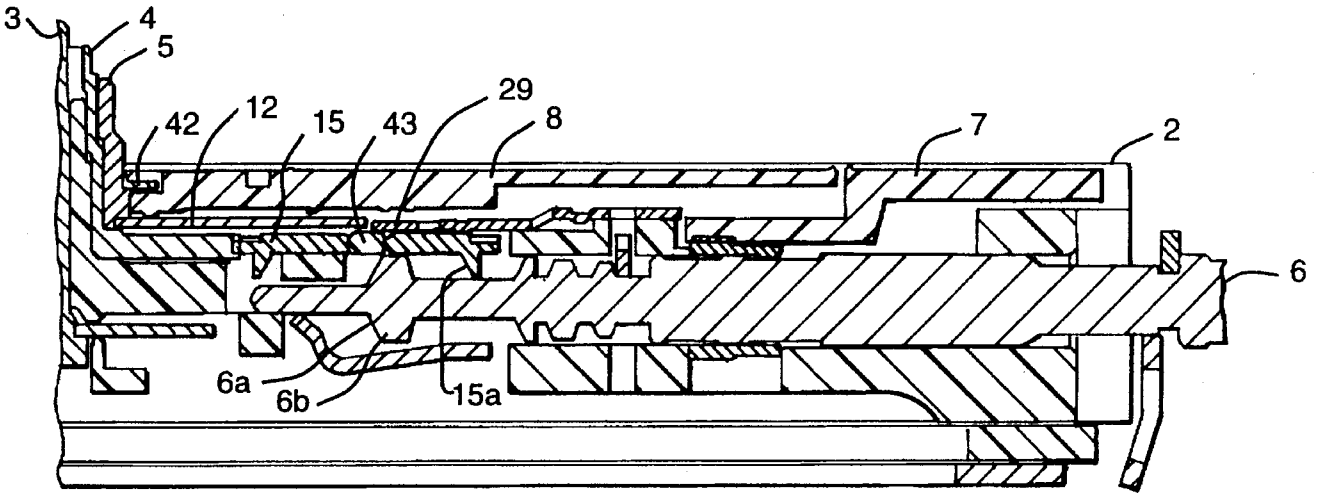

Referring now to the setting mechanism shown in FIG. 9, which is also conventional, the crown and stem assembly 6 is rotatable and radially slidable within the frame 2. Setting wheel 15 includes crown teeth 15*a*. A pinion 6*a* on the crown and stem assembly 6 includes setting pinion teeth 6*b*, which may be selectively engaged with crown teeth 15*a* by sliding the crown and stem assembly 6 radially outward from the watch movement. In the event that the teeth do not mesh properly, there is danger of damage.

In accordance with the present invention, the multifunction holding plate 16 is attached to the top surface 2*a* of central wall 2*b* by upsetting the stubs 17, 18, 19 (FIGS. 5 and 6). Holding plate 16 is shown in FIG. 5 in a view which shows one of the radially extending retaining fingers 21 overlapping the periphery of hour wheel 12 holding it in place. Further, holding plate 16 includes outer peripheral portions 16*e* overlapping teeth 7*b* of date ring 7 to hold it in place.

Another function of the multifunction holding plate is seen by reference to FIG. 9. Setting wheel 15 is mounted upon a bearing stub 43 on central wall 2*a* so that the setting wheel may move in an axial direction with respect to the common axis of coaxial members 3, 4, 5. The relatively flexible retaining leg 29 retains setting wheel 15 on stub 43. However in the case of slight misalignment between crown teeth 15*a* and setting pinion teeth 6*a*, the axially flexible retaining leg 29 will yield and permit setting wheel 15 to rise and prevent damage to the crown teeth 15*a* until they come into proper engagement.

Figure 11:
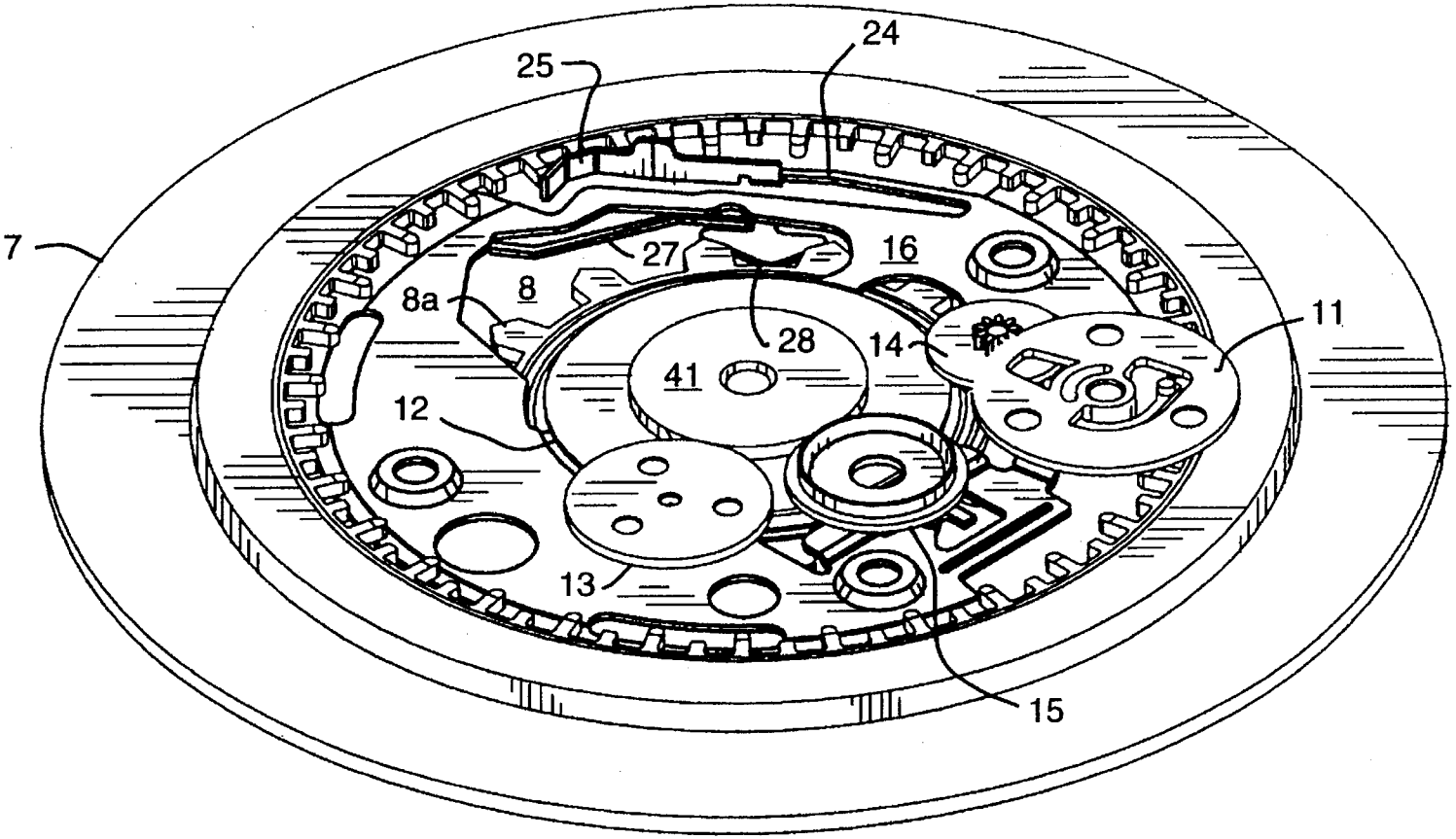

FIG. 11 is a view from the movement side, showing the various elements associated with the calendar mechanism, without the movement frame. FIG. 11 is inverted from previous perspective views shown in FIGS. 1–3. Center wheel 41 is connected via minute wheel 13 to drive hour wheel 12. Setting wheel 15 is also engaged with center wheel 41. The calendar mechanism includes the date pinion 14 connected to the hour wheel 12 so as to drive the date wheel 11. The day disc 8 includes on its underside radial teeth 8a. The radially flexible first and second spring detenting legs 24, 27 are formed from the multifunctional holding plate as previously described in connection with FIG. 4.

The multifunctional holding plate also serves to retain other elements which previously have been assembled separately. The multifunctional holding plate retains the hour wheel 12. As seen in FIG. 7, hour wheel 12 overlaps the date pinion 14, which in turn overlaps the date ring 11, so it indirectly also holds these elements in place. Also hour wheel 12, as seen in FIG. 8, overlaps the minute wheel 13 to hold this member in place. And, of course, the holding plate flexible retaining leg 29 directly holds the setting wheel in place. These elements together with the date ring 8 are all held in place in a calendar date watch. If the movement is for a day/date watch, it is only necessary to assemble the day disc 8 to the movement after the holding plate 16 has been fixed to the frame, and to attach the day disc 8 with the holding ring 42.

Thus there has been described an improved analog wristwatch movement for an analog wristwatch with date ring. The multifunctional holding plate serves several purposes. First it holds the date ring in place with its outer portions overlapping the date ring teeth. Secondly, it holds the hour wheel, center wheel assemblies in place by means of radially extending relatively inflexible retaining fingers overlapping the outer periphery of the hour wheel. Thirdly, it provides radially flexible detenting spring legs formed in parts of the plate and terminating in detenting members which engage radial teeth on the date ring (and on the day disc if desired). Lastly, it includes at least one axially flexible retaining leg engaging the setting wheel to retain it in place while allowing limited movement to permit selective engagement by the setting pinion without damage. Thus there has been described an improved analog wristwatch movement, which is easily transportable and may be handled as a single member in subsequent assembly operations.

While there has been described what is considered to be the preferred embodiment of the invention, other modifications will occur to those skilled in the art, and it is desired to secure in the appended claims all such modifications as fall within the true spirit and scope of the invention.

We claim:

1. An improved analog wristwatch movement having a frame, a timekeeping gear train disposed in said frame including an hour wheel and a center wheel coaxially disposed on an axis, a date mechanism driven by said gear train including a date ring with detenting teeth coaxially disposed on said axis, and a time setting mechanism including a setting wheel connected to said center wheel, said time setting mechanism including a radially slidable setting pinion which is selectively engageable with said setting wheel, wherein said improvement comprises:

a multifunctional holding plate defining a central aperture and adapted to be connected to said frame with the aperture substantially centered on said axis, said plate having outer peripheral portions overlapping portions of said date ring to hold the date ring in place, said plate further defining a plurality of retaining fingers extending radially into said aperture so as to overlap the outer periphery of the hour wheel and to retain the hour wheel and center wheel in place, said plate further defining a first detenting spring leg formed by an outer part of said plate and terminating in a first detenting member engaging said detenting teeth of the date ring.

2. The improvement according to claim 1, wherein said plurality of retaining fingers are relatively inflexible.

3. The improvement according to claim 1, wherein said first detenting spring leg is flexible in a radial direction.

4. The improvement according to claim 1, said plate further including at least one axially flexible retaining leg defined by a plate portion and engaging said setting wheel to retain it in place while allowing limited movement to permit selective engagement by the setting pinion without damage.

5. The improvement according to claim 1, further including a day disc driven by said date mechanism, the day disc including detenting teeth, and wherein the plate defines a second detenting spring leg formed by a portion of the plate and terminating in a second detenting member engaging the detenting teeth of the day disc.

6. The improvement according to claim 5, wherein said day disc detenting teeth extend radially inward and wherein said second detenting spring leg is flexible in a radial direction.

7. An improved analog wristwatch movement having a frame, a timekeeping gear train disposed in said frame including an hour wheel and a center wheel coaxially disposed on an axis, a date mechanism driven by said gear train including a date ring with detenting teeth coaxially disposed on said axis, a time setting mechanism including a setting wheel connected to said center wheel, said time setting mechanism including a radially slidable setting pinion which is selectively engageable with said setting wheel, and a day disc driven by said date mechanism, wherein said improvement comprises:

a multifunctional holding plate defining a central aperture and adapted to be connected to said frame with the aperture substantially centered on said axis, said plate having outer peripheral portions overlapping said date ring detenting teeth to hold the date ring in place, said plate further defining a plurality of relatively inflexible retaining fingers extending radially into said aperture so as to overlap the outer periphery of the hour wheel and to retain the hour wheel and center wheel in place, said plate further defining a first detenting spring leg formed by an outer part of said plate and terminating in a first detenting member engaging said detenting teeth of the date ring, said plate further including at least one axially flexible retaining leg defined by a plate portion and engaging said setting wheel to retain it in place while allowing limited movement to permit selective engagement by the setting pinion without damage, said plate also defining a second radially flexible detenting spring leg formed by a portion of the plate and terminating in a second detenting member engaging the detenting teeth of the day disc.

* * * * *